US006186420B1

(12) United States Patent
Hofmann

(10) Patent No.: US 6,186,420 B1
(45) Date of Patent: Feb. 13, 2001

(54) FUEL INJECTION VALVE FOR INTERNAL COMBUSTION ENGINES

(75) Inventor: Karl Hofmann, Remseck (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/508,716

(22) PCT Filed: May 3, 1999

(86) PCT No.: PCT/DE99/01284

§ 371 Date: May 15, 2000

§ 102(e) Date: May 15, 2000

(87) PCT Pub. No.: WO00/05500

PCT Pub. Date: Feb. 3, 2000

(30) Foreign Application Priority Data

Jul. 22, 1998 (DE) ..... 198 32 940

(51) Int. Cl.[7] ..... B05B 1/30
(52) U.S. Cl. ..... 239/575; 239/590.5; 123/510
(58) Field of Search ..... 123/510; 239/533.11, 239/86, 590.5, 575

(56) References Cited

U.S. PATENT DOCUMENTS 1,157,315 * 10/1915 Lemp ..... 239/86
1,964,218 * 6/1934 Schargorodsky ..... 239/86
2,067,131 * 1/1937 Schlaupitz ..... 239/86
3,499,605 * 3/1970 Dreisin ..... 239/86
5,360,164 * 11/1994 Pape et al. ..... 239/88
5,365,906 * 11/1994 Deweerdt ..... 123/467
5,421,306 * 6/1995 Talaski ..... 123/510
5,584,999 * 12/1996 Cooke ..... 210/439
5,879,553 * 3/1999 Fulford ..... 239/590.5
5,996,908 * 12/1999 Hofmann et al. ..... 239/533.3

* cited by examiner

*Primary Examiner*—Carl S. Miller
(74) *Attorney, Agent, or Firm*—Ronald E. Greigg; Edwin E. Greigg

(57) ABSTRACT

A fuel injection valve for internal combustion engines, having a fuel inlet conduit, which originates at a connection stub and discharges at at least one injection opening. A rodlike fuel filter is inserted into the fuel inlet conduit and is guided in the inlet conduit on opposite axial ends. Two groups of longitudinal grooves are formed in the jacket face each of which are axially closed on one end. The first group of longitudinal groove originate at an upper end face of the fuel filter remote from the injection opening, and the second group originates at a lower fuel filter end face oriented toward the injection opening. The size of the flow cross section at the fuel filter and the size of the flow cross section of the inlet conduit in the region downstream of the fuel filter amounts to from approximately 5–10 times the size of the total flow cross section of all the injection openings in the fuel injection valve.

7 Claims, 2 Drawing Sheets

VI
VI

FUEL INJECTION VALVE FOR INTERNAL COMBUSTION ENGINES

PRIOR ART

The invention is based on a fuel injection valve for internal combustion engines. One such fuel injection valve, known from German Patent Disclosure DE 196 08 608, has a fuel inlet conduit leading away from a connection stub for a fuel injection line, which conduit discharges at an injection opening into the combustion chamber of the engine to be supplied. For trapping dirt particles and chips in the fuel, a rodlike fuel filter is inserted into the inlet conduit and is guided via collar faces, provided on its axial face ends, in a bore of the fuel inlet conduit. The rotationally symmetrical filter body of the fuel filter has a middle portion of reduced diameter between its two collar faces. Two groups of longitudinal grooves axially closed on one end are machined into this middle portion, of which a first group originates at an upper end face of the filter body remote from the injection opening, and a second group originates at a lower end face thereof, oriented toward the injection opening. The longitudinal grooves of the first and second groups are distributed in alternation over the circumference of the filter body. When there is a flow of fuel through the fuel inlet conduit, the fuel is forced at the filter body to pass through the narrow gap between the profiled outer circumference of the filter body in the center portion and the wall surrounding the filter body of the inlet conduit, so that dirt particles, chips and so forth entrained with the fuel are restrained, beyond a certain size, when the fuel flows from the longitudinal grooves of one group over into the longitudinal grooves of the other group. The restrained particles then accumulate at the closed lower end of reduced cross section of the longitudinal grooves originating at the upper end face, remote from the injection opening.

The known fuel injection valve has the disadvantage that a relatively large idle volume exists at the fuel filter. Furthermore, the pressure losses, because of the poor adaptation between the flow cross sections of the fuel filter and the inlet line and the flow cross sections at the injection openings, are too great to allow effective conversion of the high fuel pressure, built up by the high-pressure fuel pump, at the injection openings of the injection valve. The known fuel injection valves, for use in direct-injection internal combustion engines, thus no longer meet the high injection pressures demanded.

ADVANTAGES OF THE INVENTION

The fuel injection valve according to the invention for internal combustion engines, has the advantage over the prior art that by the adaptation of the flow cross sections of the fuel filter and the inlet conduit to the total injection cross section of the injection valve, the pressure losses within the fuel inlet conduit and in particular at the fuel filter can be greatly reduced. By embodying the fuel injection valve according to the invention, the idle volume in the fuel inlet conduit and at the fuel filter can furthermore be reduced, which has a still more favorable effect on the injection event. These improvements are attained by the layout according to the invention of the size of the flow cross section of the fuel filter and of the flow cross section of the fuel inlet conduit downstream of the fuel filter, which should advantageously be 5–10 times the size of the total flow cross section of all the injection openings of the fuel injection valve. In this way, pressure losses caused by throttling action as the fuel flows through the fuel inlet conduit are averted. It is especially advantageous to make the flow cross section at the fuel inlet and at the fuel outlet of the fuel filter the same size as or slightly larger than the flow cross section of the region of the fuel inlet conduit adjoining the fuel filter downstream. Throttle losses at the fuel filter can thus be reliably precluded. A further advantage is attained by reducing the number of longitudinal grooves in the filter body from six grooves to four. In this way, once again, the idle volume at the end of the filter and the throttle losses as the fuel flows between the individual longitudinal grooves of the two groups can be reduced. The longitudinal recesses on the fuel filter can be embodied either as longitudinal grooves or as faces. To reduce the pressure losses as the fuel enters the fuel filter, an inlet chamfer is advantageously provided at the upper end face of the fuel filter as well. To reduce the idle volume in the fuel inlet conduit, the filter body of the fuel filter also, on its lower, outlet-side end, has a stop cone, with which the fuel filter rests on a conical seat face, complementary to the stop cone, of the inlet conduit. For connecting the longitudinal grooves that are open on the injection side to the fuel inlet conduit, two oblique polished sections are made in the stop cone face of the fuel filter, which originate at the end face toward injection of the fuel filter and discharge into the group of longitudinal grooves that are open toward the injection opening. The conical seat face in the fuel inlet conduit and the stop cone face on the fuel filter cooperating with it are advantageously embodied with a cone angle between 45 and 90°. It is furthermore especially advantageous to embody the oblique polished sections in the stop cone face with this kind of cone angle as well.

Further advantages and advantageous features of the subject of the invention can be learned from the specification, drawing and claims.

BRIEF DESCRIPTION OF THE DRAWINGS

One exemplary embodiment of the fuel injection valve of the invention for internal combustion engines is shown in the drawings and will be described in further detail below.

DESCRIPTION OF THE EXEMPLARY EMBODIMENT

Figure 1:
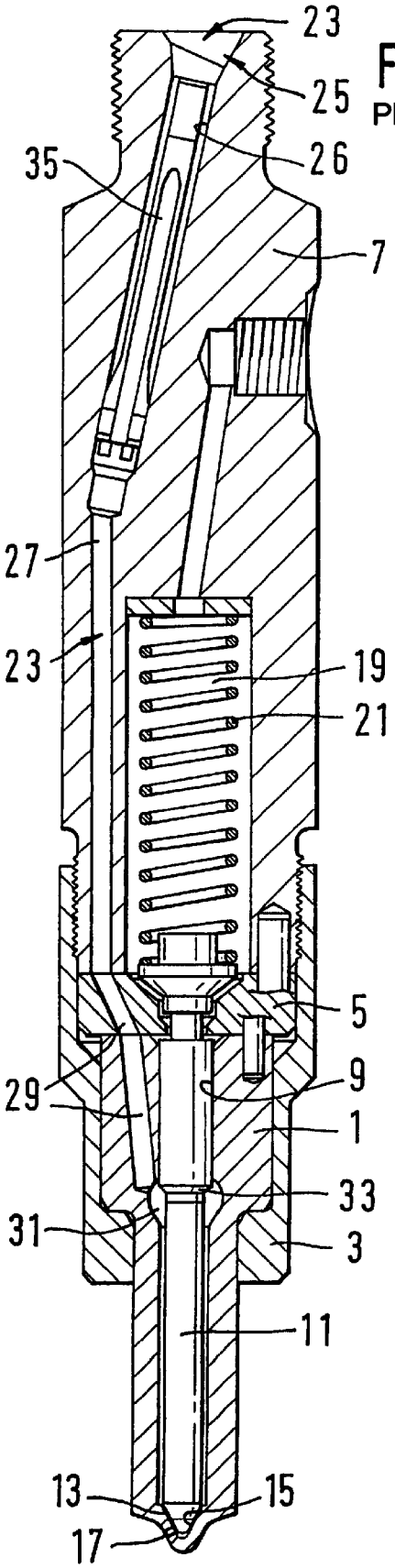
FIG. 1 PRIOR ART
FIG. 1 shows a longitudinal section through a known fuel injection valve including the invention.

The known fuel injection valve shown in FIG. 1 for internal combustion engines has a valve body 1, protruding into the combustion chamber of the engine to be supplied, which by means of a tightening nut 3 and the interposition of a shim 5 is braced axially against a valve holding body 7. A pistonlike valve member 11 is axially guided in a guide bore 9 in the valve body 1 and with its lower end face, toward the combustion chamber, the piston forms a valve sealing face 13, with which the valve member 11 cooperates to control an opening cross section with an inward-protruding valve seat 15 in the guide bore 9. At least one injection opening 17 is provided downstream of the valve seat 15; this injection opening originates at the guide bore 9 and discharges into the engine combustion chamber. In a spring chamber 19 in the valve holding body 7, a valve spring 21 is disposed, which urges the valve member 11 toward the valve seat 15 in the closing direction. A fuel inlet conduit 23 is also provided in the valve holding body 7 and penetrates the valve holding body 7 axially from a connection stub 25, provided on its upper end face remote from the injection opening 17, for a fuel injection line, not shown, as far as the shim 5, and comprises two bore portions 26, 27 of different diameters. The lower bore portion 27 of the fuel inlet conduit 23 discharges at a connecting conduit 29 of the fuel inlet conduit 23; the connecting conduit penetrates the shim 5 and discharges into a pressure chamber 31, surrounding the valve member 11, that extends in the form of an annular gap along the shaft of the valve member 11 as far as the valve seat 15. In the region of the pressure chamber, the valve member 11 is provided with a pressure shoulder 33, remote from the valve seat 15, at which the high fuel pressure engages the valve member 11 in the opening direction.

A fuel filter 35 with a rodlike filter body is inserted into the upper bore portion 26 of the fuel inlet conduit 23 and forces the inflowing fuel to pass through narrow gaps that are formed between the profiled outer circumference of the filter body 35 and the wall, surrounding the filter body, of the bore portion 26 of the fuel inlet conduit 23. The fuel is thus filtered, and entrained dirt particles and chips beyond a certain size are restrained.

Figure 2:
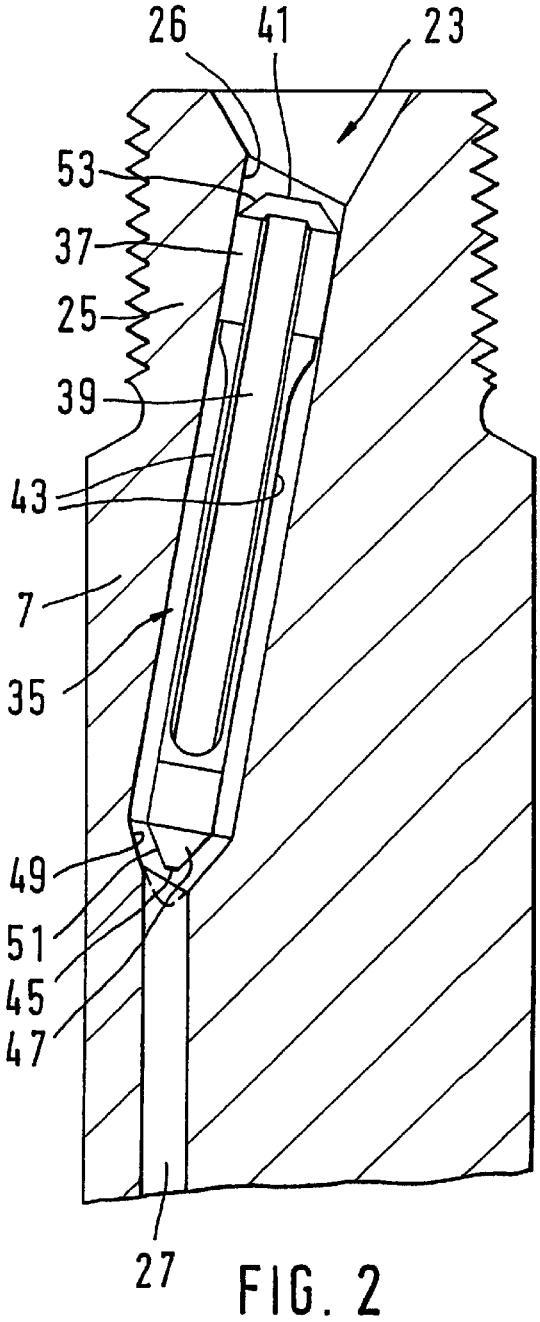
FIG. 2 is an enlarged detail from FIG. 1 showing the embodiment of the fuel filter and the inlet conduit according to the invention.
Figures 3, 4, 5, 6, 7:
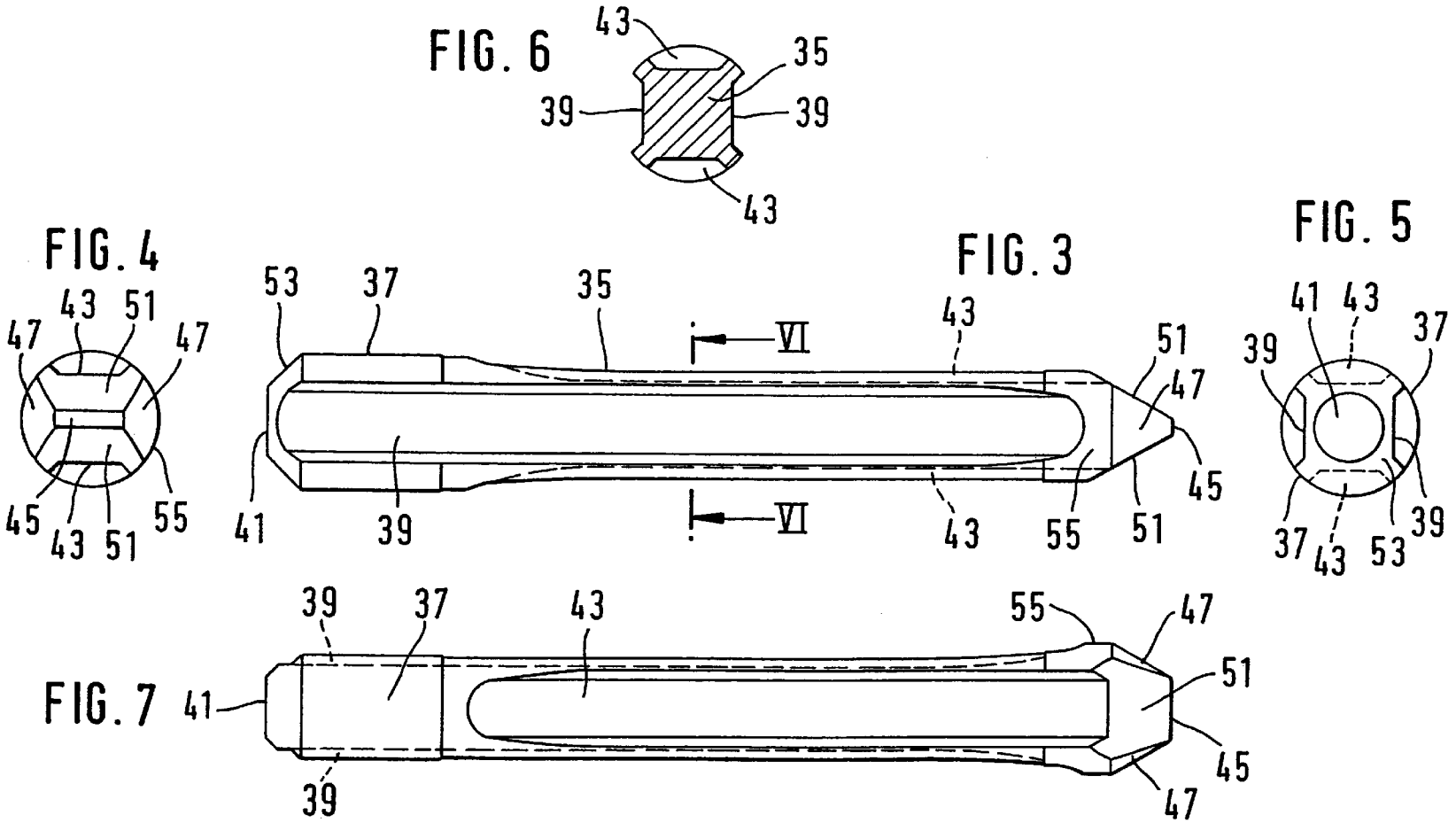
FIGS. 3–7 show various views of the fuel filter in individual fragmentary views.

The fuel filter 35 according to the invention, shown in its installed position enlarged in FIG. 2 and in various views in FIGS. 3–7, has a rodlike filter body, which on each of its axial ends has a cross-sectional enlargement that forms a collar. An upper collar, remote from the injection opening 13, forms a press-fit collar 37, and a lower collar, toward the injection opening 13, forms a guide collar 55. The fuel filter 35 also has in its jacket face two groups of longitudinal grooves, axially closed on one end, of which a first group of longitudinal grooves 39 originates at an upper end face 41, remote from the injection opening 13. A second group of longitudinal grooves 43 originates at a lower end face 45 of the fuel filter 35, oriented toward the injection opening 13. As shown in FIGS. 3–7, two longitudinal grooves 39 and two longitudinal grooves 43 each are provided, which are distributed, alternating with one another, over the circumference of the fuel filter 35. FIG. 3 shows a first side view of the fuel filter 35, and FIGS. 4 and 5 show a view from above and below, respectively, on this side view. FIG. 6 shows a cross section through the fuel filter body 35. FIG. 7 shows a further view, rotated 90° about the longitudinal axis relative to FIG. 3, of the fuel filter 35 of the invention.

As shown in FIG. 7, the fuel filter 35, on its lower end face 45, has a stop cone 47 with which it rests on a conical seat face 49 of the inlet conduit 23. This conical seat face 49 of the inlet conduit 23 is formed at the cross-sectional transition between the upper bore portion 26 of larger diameter and the lower bore portion 27 of smaller diameter. The cone angle of the stop cone 47 and of the conical seat face 49 is 60° in the exemplary embodiment, but it can alternatively be designed to range between 45 and 90°. To assure the flow of fuel from the second group of longitudinal grooves 43 over into the portion of the fuel inlet conduit 23 formed by the bore 27 and located downstream of the fuel filter 35, two oblique polished sections 51 are machined into the stop cone 47, which originate at the lower end face 45 and discharge into the longitudinal grooves 43 and preferably have the same cone angle as the stop cone 47. A chamfer 53 is also provided, on the upper end of the fuel filter farther away from the injection, at the transition between the upper end face 41 and the circumferential face of the press-fit collar 37.

To enable reliable avoidance of flow cross sections when the fuel flows at high pressure through the fuel inlet conduit 23 and the fuel filter 33, the size of the total flow cross section at the fuel filter 35 and the size of the flow cross section of the fuel inlet conduit 23 in the region 27 downstream of the fuel filter 35 is designed to be approximately 5–10 times as large as the size of the total flow cross section of all the injection openings 17 provided. The smallest cross section of the lower fuel inlet conduit portion 27 determines the flow cross section of the fuel inlet conduit 23. The total flow cross section at the fuel filter 35, conversely, is determined by the sum of all the overflow edges between the individual groups of longitudinal grooves 39, 43 and the overflow faces in the inlet and outlet regions of the press-fit collar 37 and the polished sections 51. The flow cross section at the fuel entry and the fuel outlet of the fuel filter 35 is embodied to be the same size as or slightly larger than the flow cross section of the fuel inlet conduit 23 in the region of the bore 27.

With the fuel filter 35, shown enlarged in FIGS. 2–7, it is thus possible in the fuel injection valve of the invention to considerably reduce the idle volume in the fuel inlet conduit 23 and at the fuel filter 35, as well as pressure losses that occur upon a flow through these components, so that the high fuel pressure built up by the high-pressure fuel pump can be transmitted to the injection openings of the fuel injection valve that discharge into the combustion chamber.

The foregoing relates to a preferred exemplary embodiments of the invention, it being understood that other variants and embodiments thereof are possible within the spirit and scope of the invention, the latter being defined by the appended claims.

What is claimed is:

1. A fuel injection valve for internal combustion engines, comprising a fuel inlet conduit (23), which originates at a connection stub (25) and discharges at a least one injection opening (17), and into which a rodlike fuel filter (35) is inserted, said fuel filter is guided in the inlet conduit on axial ends of the fuel filter and into whose jacket face two groups of longitudinal grooves, axially closed on one end, are machined, a first group of longitudinal grooves (39) originate at an upper end face (41) of the fuel filter (35) remote from the injection opening (17), and a second group (43) originates at a lower fuel filter end face (45) oriented toward the injection opening (17), the size of the flow cross section at the fuel filter (35) and the size of the flow cross section of the fuel inlet conduit (23) in the region (27) downstream of the fuel filter (35) amounts to from 5–10 times a size of a total flow cross section of all the injection openings (17) in the fuel injection valve.

2. The fuel injection valve according to claim 1, in which the flow cross section at the fuel inlet and at the fuel outlet of the fuel filter (35) is the same size as or slightly larger than the flow cross section of the region (27) of the fuel inlet conduit (23) adjoining the fuel filter (35) downstream.

3. The fuel injection valve according to claim 1, in which of the group of longitudinal grooves (39, 43) closed on one end, two longitudinal grooves or faces are provided, and the longitudinal grooves of the first and second groups (39, 43) are distributed in alternation over the circumference of the fuel filter (35).

4. The fuel injection valve according to claim 1, in which a chamfer (53) is provided on the upper end face (41), forming a fuel inlet region, of the fuel filter (35).

5. The fuel injection valve according to claim 1, in which on a lower, outlet-side end face (45) of the fuel filter (35), a stop cone (47) is provided, with which the fuel filter (35) rests on a conical seat face (49) of the inlet conduit (23).

6. The fuel injection valve according to claim 5, in which two oblique polished sections (51) are provided on the stop cone (47), which discharge into the longitudinal grooves (43) of the second group that is open toward the injection opening (17).

7. The fuel injection valve according to claim 5, in which the stop cone (47) on the fuel filter (35) and the conical seat face (49) inside the fuel inlet conduit (23) have a cone angle of between 45 and 90°.

* * * * *